US005159720A

United States Patent [19]

Scott, Jr.

[11] Patent Number: 5,159,720

[45] Date of Patent: Nov. 3, 1992

[54] HUNTER'S HAT

[76] Inventor: Gerald C. Scott, Jr., 1186 Birchcrest Blvd., Port Charlotte, Fla. 33952

[21] Appl. No.: 829,773

[22] Filed: Jan. 31, 1992

[51] Int. Cl.[5] ..... A42B 1/00

[52] U.S. Cl. ..... 2/175; 2/177; 2/178; 2/192; 2/195; 2/198; 2/200; 2/209.5; 2/209.7

[58] Field of Search ..... 2/195, 198, 209.5, 209.7, 2/175, 177, 178, 192, 200, DIG. 1; 351/46

[56] References Cited

U.S. PATENT DOCUMENTS 4,551,860 11/1985 Smit et al. ..... 2/175
4,812,031 3/1989 Evans ..... 351/46
5,091,995 3/1992 Oates ..... 2/195

FOREIGN PATENT DOCUMENTS 585529 3/1977 Switzerland ..... 2/195

*Primary Examiner*—Werner H. Schroeder
*Assistant Examiner*—Gloria Hale
*Attorney, Agent, or Firm*—Frank A. Lukasik

[57] ABSTRACT

Improved head wear for providing concealment for the wearer and allowing maximum overhead visibility comprising a camouflage colored material crown, and a front brim section consisting of dull, camouflage colored see-through nylon mesh sewed to the crown and means for supporting said mesh in an extended position for concealment.

6 Claims, 2 Drawing Sheets

HUNTER'S HAT

BACKGROUND OF THE INVENTION

1. Field of the invention

This invention relates generally to head wear and more particularly to camouflaged head wear worn by wild fowl hunters.

2. Discussion of the prior art

Caps have been provided for use when the wearer's eyes may be subject to glare, as for sports and the like. Such known caps are distinguished by a visor formed from thin sheet plastic material such as cellulose acetate, which plastic is colored, usually a dark green, so as to filter out the glare producing elements of the sun's rays. However, such caps having the glare proof visors are of specialized and limited usage, being inappropriate for ordinary wear when the wearer is not covered with glare arising from sun rays or the like. Also, the exposed, thin plastic visor detracts from the overall appearance of the cap and imparts a somewhat unprepossessing appearance to the same. Finally, the thin plastic visor has little resistance to bending, creasing or tearing and within a short time the cap may have a somewhat bedraggled appearance.

U.S. Pat. No. 1,783,549 to Solomon discloses a hat having a brim and crown constructed of canvas or other light fabric material and an eye shade of transparent material in the brim. The front part of the brim from the lower edge of the crown to the binding is cut out to provide an opening of more or less crescent shape form wherein a sheet of CELLULOID or other transparent material, preferably of a dark color, is installed.

U.S. Pat. No. 2,416,062 to Mercer discloses a hat with a brim made of plastic having a requisite strength or of suitably stiffened fabric, pulp, or the like. Portions of the brim can be reduced in weight by forming large holes therein of any desired form or arrangement. The brim has a removable, washable cover formed of a light fabric. The lower portion of the cover is held securely to the flange by means of an elastic material which is seated in the marginal portion of the cover and serves to press against the concave surface of the flange.

U.S. Pat. No. 3,128,474 to Feldman discloses a glare proof cap wherein the visor includes the usual sheet of colored plastic material adapted to filter glare producing rays, together with a fabric covering for at least on surface of the plastic sheet which coverings either conceal or modify the appearance of the plastic sheet so as to markedly improve the appearance thereof, yet allowing light rays to pass therethrough to substantially maintain the glare proof properties of the plastic portion of the visor.

Neither of the above mentioned references would provide the coverage nor concealment required for hunting wild fowl, as for example, ducks or geese. In wild fowl hunting, it is extremely important to blend in with the surrounding environment. Hunters are usually concealed in duck blinds or camouflaged boats, or some other undetectable shelter. It is particularly important to remain motionless as the quarry approaches since the airborne fowl have extremely sharp vision and can detect the slightest motion. If motion, or other threatening gesture is detected, the wild fowl continue to fly by and do not descend within range of the hunter's limited range weapons.

The visor with transparent portion disclosed by the patent to Solomon would not provide the cover/visibility provided by the instant invention. The patent to Mercer would only be partially effective to provide visibility above and only if sufficient holes are provided in the front portion. Although each of the references pertain to hats, none of the references are designed to be used in a specialized field, such as hunting, with its unique problems of remaining hidden from view as in hunting waterfowl. Each of the prior art transparent visors, being fabricated from glare proof material, do not provide the visibility required to see through the material and in addition, may reflect part of the light back above the wearer and be seen by the quarry.

SUMMARY OF THE INVENTION

The invention is a hunting hat with a see-through nylon mesh front in dull camouflage (camo) pattern that matches the rest of the hat to provide undetectable cover from above. By looking through the mesh front, a hunter is able to see the water fowl as it comes into view while the hunter's face is still being hidden by the camo design. The invention comprises at least two variations, comprising a standard bucket hat and/or a baseball type cap and would work equally well with other types of head wear.

It is therefore an object of the invention to provide improved head wear wherein the visor is adapted to provide concealment for the wearer and yet allows maximum visibility overhead without upward head movement.

It is a further object of the invention to provide improved head wear having a brim constructed of fabric material and a portion of which there is embodied an eye shade of dull, nylon mesh material.

It is a further object of the invention to provide improved water fowl hunter's head wear constructed of camouflage colored material and having an eye shade of camouflage colored dull, nylon mesh material.

The above objects and advantages will become more apparent when reference is made to the following description taken in conjunction with the accompanying drawings.

DESCRIPTION OF THE PREFERRED EMBODIMENT

Figure 1:
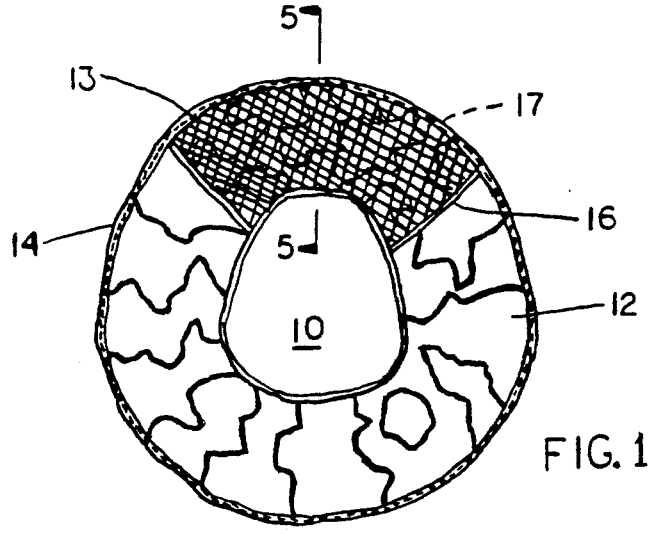
FIG. 1 is a top plan view of a hat embodying the invention.

In describing a preferred embodiment of the invention illustrated in the drawings, specific terminology will be used for the sake of clarity. However, the invention is not intended to be limited to the specific terms selected, and it is to be understood that each specific term includes all technical equivalents which operate in a similar manner to accomplish a similar purpose.

Figure 2:
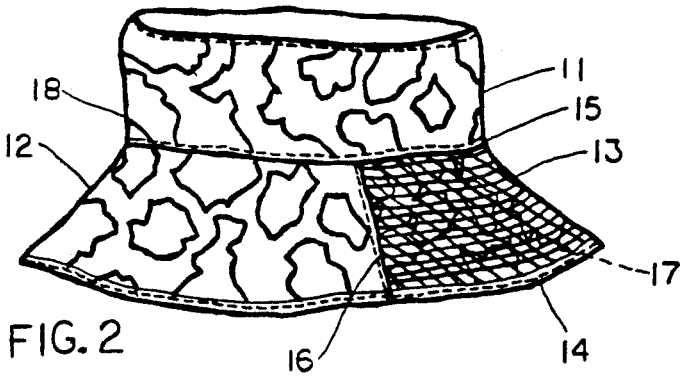
FIG. 2 is a side elevational view of a hat embodying the invention.

Referring now to FIGS. 1 and 2, reference numeral 10 generally indicates a hunter's hat of the invention which is made up of three major parts, the crown 11, the brim 12 and the see-through dull, nylon mesh 13 front portion. The crown 11 and the brim 12 may be constructed of a suitable water repellent fabric material such as cotton duck or nylon or any suitable, rugged fabric material. The fabric material is preferably colored in the dull camouflage pattern colors commonly used for hunting gear. The crown 11 may be constructed of several parts securely stitched together. A binding 14 may be secured to the edge of the brim 12.

Figure 5:
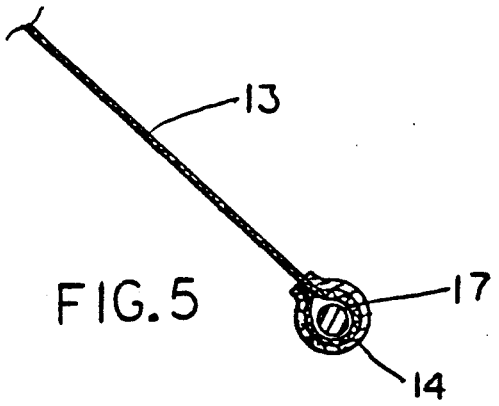
FIG. 5 is a fragmentary section taken on the line 5—5 of FIG. 1.

The front part of the brim 12 from the lower edge of the crown 11 to the binding 14 is cut out to provide an opening therein of more or less 90°, 45° to each side of the line 5—5 of FIG. 5. The opening is adapted to be occupied by a similarly shaped section of nylon mesh 13 which is sewed at its inner edge 15 to the crown 11, and at its side edges 16 to the brim 12. To the outer edge of the nylon mesh 13, a wire rim 17 is attached by rolling the mesh 13 over the wire rim 17 and securing the wire rim 17 with the binding 14 to the outer edge of the nylon mesh 13, the same lines of stitching 18 securing the binding 14 to the nylon mesh 13 and fastening the wire rim 17. The wire rim 17 is extended into the brim 12 and held to the brim 12 by the binding 14. The wire rim 17 may be made of plastic, steel, or stainless steel if preferred.

Thus it may be understood that the nylon mesh and the wire rim 17 extend across the front of the hat 10, brim 12, on either side of the front center thereof and by securely connecting the nylon mesh 13 over the wire rim 17 a very strong and secure connection is produced. This front wire rim 17 incorporated in the brim 12 of the hat 10 also serves to stiffen this part of the brim 12 and to retain the same in a more or less angularly projecting position relative to the forehead of the wearer. Thus, the front of the hat brim 12 may be pulled down low over the eyes to properly conceal any eye movement and yet afford maximum visibility above the wearer's head through the nylon mesh 13.

Figure 4:
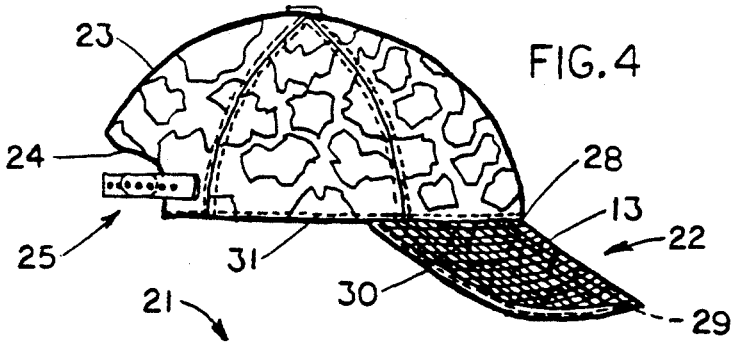
FIG. 4 is a side elevational view of a cap embodying the invention.
Figure 3:
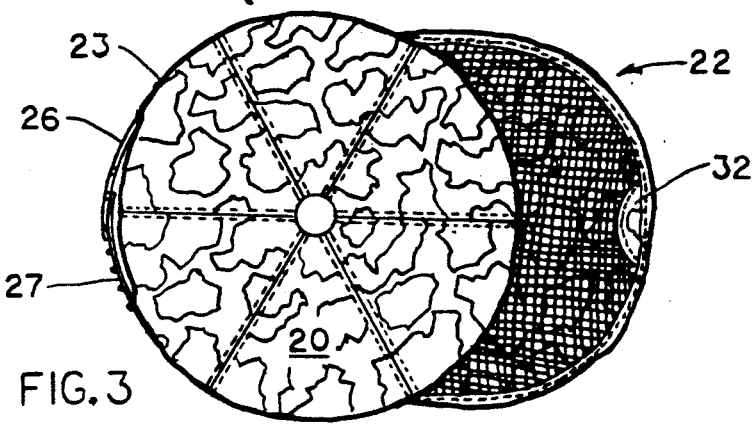
FIG. 3 is a top plan view of a cap embodying the invention.

FIGS. 3 and 4 show a second embodiment of the see-through, dull, nylon mesh 13 as it is used as a visor for a cap of the baseball type. Numeral 10 designates a cap embodying the invention, comprising a crown portion 21 and a visor portion 22 extending from an edge thereof. The crown portion 21 is formed of fabric panels 23 of a suitable water repellent material such as camouflaged cotton duck or nylon or any suitable, rugged fabric material. The rear panels 23 may be cut out as at 24 to provide a notched lower portion therein, which notched portion may be bridged by a two-piece band 25. Band 25 is comprised of a hole strap 26 and a projection strap 27 which when mated, provide an adjustment of length to provide an adjustable size to fit all head sizes.

The visor 22 is of the usual configuration with a convexly curved forward edge and a rear edge of concave shape for securement to a forward edge of crown 21. Visor 22 comprises a shaped section of nylon mesh 13 which is sewed at its inner edge 28 to the crown 21. To the outer edge of the nylon mesh 13, a wire rim 29 is attached by rolling the mesh 13 over the wire rim 29 and securing the wire rim 29 with the binding 30 to the outer edge of the nylon mesh 13, the same lines of stitching 31 securing the binding 30 to the nylon mesh 13 and fastening the wire rim 29. An oval shaped insert 32 is also stitched with the binding 30 to provide additional support for the nylon mesh 13 and to provide a finger gripping area for donning the cap 20.

Figure 6:
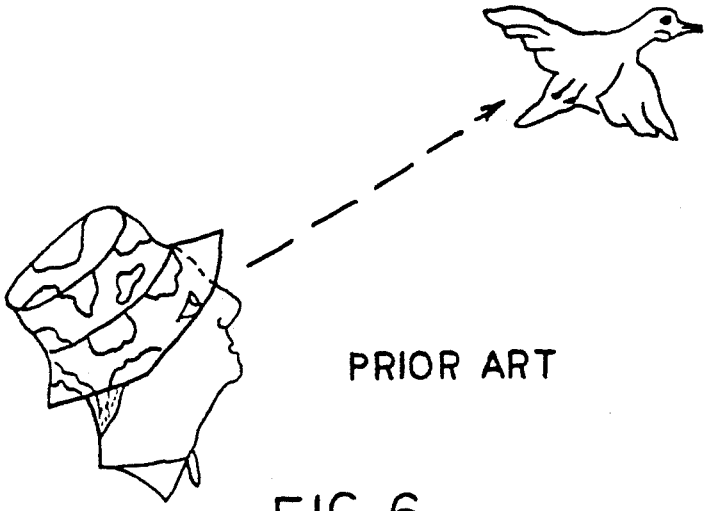
PRIOR ART FIG. 6
FIG. 6 is a diagram of a hunter wearing a prior art head wear
Figure 7:
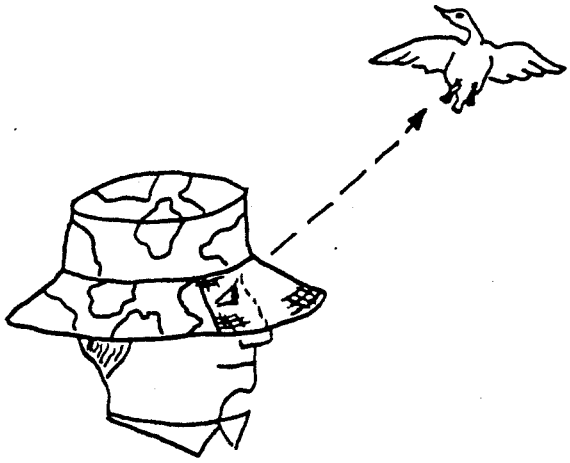
FIG. 7 is a diagram of a hunter wearing a hat embodying the invention.

FIGS. 6 and 7 show the different views seen by the hunter with the prior art hat and the new and novel see-through nylon mesh brim and/or visor of the invention. In FIG. 6, the hunter has tilted his head upward to scan his eyes overhead, thus exposing his face and frightening the fowl away with the upward motion of his head. To see waterfowl or quarry coming in, a hunter must look up to see under the brim of the hat. This, in many cases, allows the quarry to see his face and change direction before coming into gun range. In FIG. 7, the hunter need only move his eyes upwardly and he can easily see the overhead fowl without movement of the head. By looking through the mesh front, the hunter is able to visually see waterfowl or quarry coming in while still camouflaging his face, thus increasing the number of birds coming into gun range.

While certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

What is claimed is:

1. Head wear for providing concealment for the wearer and allowing overhead visibility comprising:

a camouflage colored material crown portion having an edge portion, and a front brim section extending from said edge portion, said brim section consisting of dull, camouflage colored see-through nylon mesh and having an outer edge, side edges and having an inner edge sewn to said crown edge portion and means for supporting said mesh in an extended position for concealment.

2. Head wear as described in claim 1 having a second brim section consisting of camouflage colored material and having an inner edge sewn to said crown edge portion, opposite end edges sewn to said mesh side edges of said front brim section thereby forming a brim around said crown, and an outer edge, said means for supporting said mesh including a wire rim attached to said front brim outer edge by rolling said mesh over said wire rim and securing said wire with a binding stitched to said mesh, said binding being attached and stitched around said outer edge of said second brim section.

3. Head wear as described in claim 2 wherein said second brim section encircles 270° of said crown and said front section encircles 90° of said crown.

4. Head wear as described in claim 1 wherein said means for supporting said mesh in an extended position comprises a wire rim attached by rolling said mesh over said wire and sewing said binding to said mesh side and outer edges to form a continuous, firm support with said side and outer edges.

5. Head wear for providing concealment for the wearer and allowing overhead visibility comprising:

a camouflage colored material crown portion having an edge portion, a front brim section extending from said edge portion, said brim section consisting of dull, camouflage colored see-through nylon mesh and having an outer edge, side edges and having an inner edge sewn to said crown edge portion, and a second brim section consisting of camouflage colored material and having an inner edge sewn to said crown edge portion, opposite end edges sewn to said mesh edges of said front brim section thereby forming a brim around said crown, and an outer edge, said means for supporting said mesh including a wire rim attached to said front brim outer edge by rolling said mesh over said wire rim and securing said wire with a binding stitched to said mesh, said binding being attached and stitched around said outer edge of said second brim section.

6. Head wear for providing concealment for the wearer and allowing overhead visibility comprising:

a camouflage colored material crown portion having an edge portion, and a front brim section extending from said edge portion, said brim section consisting of dull, camouflage colored see-through nylon mesh and having an outer edge, side edges having an inner edge sewn to said crown edge portion, and a wire rim attached to said mesh by rolling said mesh outer and side edges over said wire and sewing a binding to said mesh side and outer edges to form a continuous, firm support with said side and outer edges.

* * * * *